US007753017B2

(12) United States Patent
Douse et al.

(10) Patent No.: US 7,753,017 B2
(45) Date of Patent: Jul. 13, 2010

(54) HYDRAULICALLY LASHED END PIVOT ROCKER ARM

(75) Inventors: Eric C. Douse, Pontiac, MI (US); Alan W. Hayman, Romeo, MI (US); Robert S. McAlpine, Lake Orion, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 385 days.

(21) Appl. No.: 11/960,792

(22) Filed: Dec. 20, 2007

(65) Prior Publication Data

US 2009/0159028 A1 Jun. 25, 2009

(51) Int. Cl.
*F01L 1/34* (2006.01)

(52) U.S. Cl. ..... 123/90.16; 123/90.39; 123/90.52

(58) Field of Classification Search ..... 123/90.15, 123/90.16, 90.39, 90.52
See application file for complete search history.

(56) References Cited

U.S. PATENT DOCUMENTS 6,499,451 B1 * 12/2002 Hendriksma et al. ..... 123/90.16

* cited by examiner

*Primary Examiner*—Zelalem Eshete

(57) ABSTRACT

A hydraulically lashed end pivot rocker arm assembly finds application in high performance valve trains of internal combustion engines. The rocker arm is mounted at one end upon an eccentric bearing assembly and includes a surface for engaging a valve stem at the opposite end and a roller engaged by a camshaft disposed between the ends. The eccentric bearing assembly includes a stub shaft or cylindrical body that is received within a bore in the rocker arm and an eccentric bore which receives an inner shaft which extends along the cylinder head and supports the eccentric bearings and the rocker arm assemblies. The stub shaft or cylindrical body includes an ear or lug which is engaged by a hydraulic lash adjuster disposed parallel to and offset from the vertical plane of motion of the rocker arm.

20 Claims, 4 Drawing Sheets

HYDRAULICALLY LASHED END PIVOT ROCKER ARM

FIELD

The present disclosure relates to overhead valve train assemblies for internal combustion engines and more particularly to end pivot rocker arms having offset hydraulic lash adjusters for use in overhead valve train assemblies in internal combustion engines.

BACKGROUND

The statements in this section merely provide background information related to the present disclosure and may or may not constitute prior art.

In many internal combustion engines, conventional overhead valvetrain assemblies include a rocker arm having a first end which engages a hydraulic lash adjuster, a second, opposite end which engages a valve stem and a roller or other friction reducing device in the middle of the rocker arm which engages a cam on a camshaft. So configured, there is no fixed axis about which the rocker arm pivots and thus the rocker cannot be stabilized by mounting it on a shaft. Rather, the rocker arm must be, and is, maintained in its proper position by cooperation between a convex, hemi-spherical feature of the hydraulic lash adjuster and a complementary concave, hemi-spherical feature on the rocker arm.

This mounting arrangement has not always proven to be satisfactory as side loads on the assembly may result in movement of the rocker arm out of its desired, operating position. Additionally, there are limits to the extent of rocker arm rotation and valve lift which, if exceeded, will again result in movement of the rocker arm out of position. The present invention addresses this problem.

Because the hydraulic lash adjuster, the rocker arm and the valve stem are aligned in a vertical plane and the lash adjuster and valve stem often define converging axes, it is quite common that features of the cast cylinder head designed to mount the lash adjuster and provide suitable wall thickness will result in a protrusion or boss in the intake or exhaust port which increases flow resistance and thus reduces intake and exhaust flow. This is obviously undesirable and the present invention also addresses this problem.

SUMMARY

A hydraulically lashed end pivot rocker arm assembly finds application in high performance valve trains of internal combustion engines. The rocker arm is mounted at one end upon an eccentric bearing assembly and includes a surface for engaging a valve stem at the opposite end and a roller engaged by a camshaft disposed between the ends. The eccentric bearing assembly includes a stub shaft or cylindrical body that is received within a bore in the rocker arm and an eccentric bore, that is, a bore having an axis offset from and parallel to the axis of the bore in the rocker arm. The eccentric bore receives an inner shaft which extends along a cylinder head and supports the eccentric bearings of the rocker arm assemblies. The stub shaft or cylindrical body includes an ear or lug which is engaged by a hydraulic lash adjuster disposed parallel to and offset from the vertical plane of motion of the rocker arm. As the valve lash varies, the hydraulic lash adjuster rotates the stub shaft to eliminate the lash. The inner shaft is hollow and provides high pressure oil to lubricate the inner shaft and eccentric bore interface and the stub shaft and rocker arm interface.

Thus it is an object of the present invention to provide a high performance valve train assembly.

It is a further object of the present invention to provide a high performance valve train assembly having end pivot rocker arms.

It is a still further object of the present invention to provide a hydraulically lashed end pivot rocker arm assembly.

It is a still further object of the present invention to provide a rocker arm assembly having a rocker arm and a hydraulic lash adjuster offset from the plane of the rocker arm and associated valve stem.

It is a still further object of the present invention to provide a rocker arm assembly having a rocker arm mounted at one end upon two nested, eccentric shafts.

It is a still further object of the present invention to provide a rocker arm assembly having a rocker arm mounted upon a stub shaft having a lug engaged by a hydraulic lash adjuster.

Further objects, advantages and areas of applicability of the present invention will become apparent from the description provided herein. It should be understood that the description and specific examples provided are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
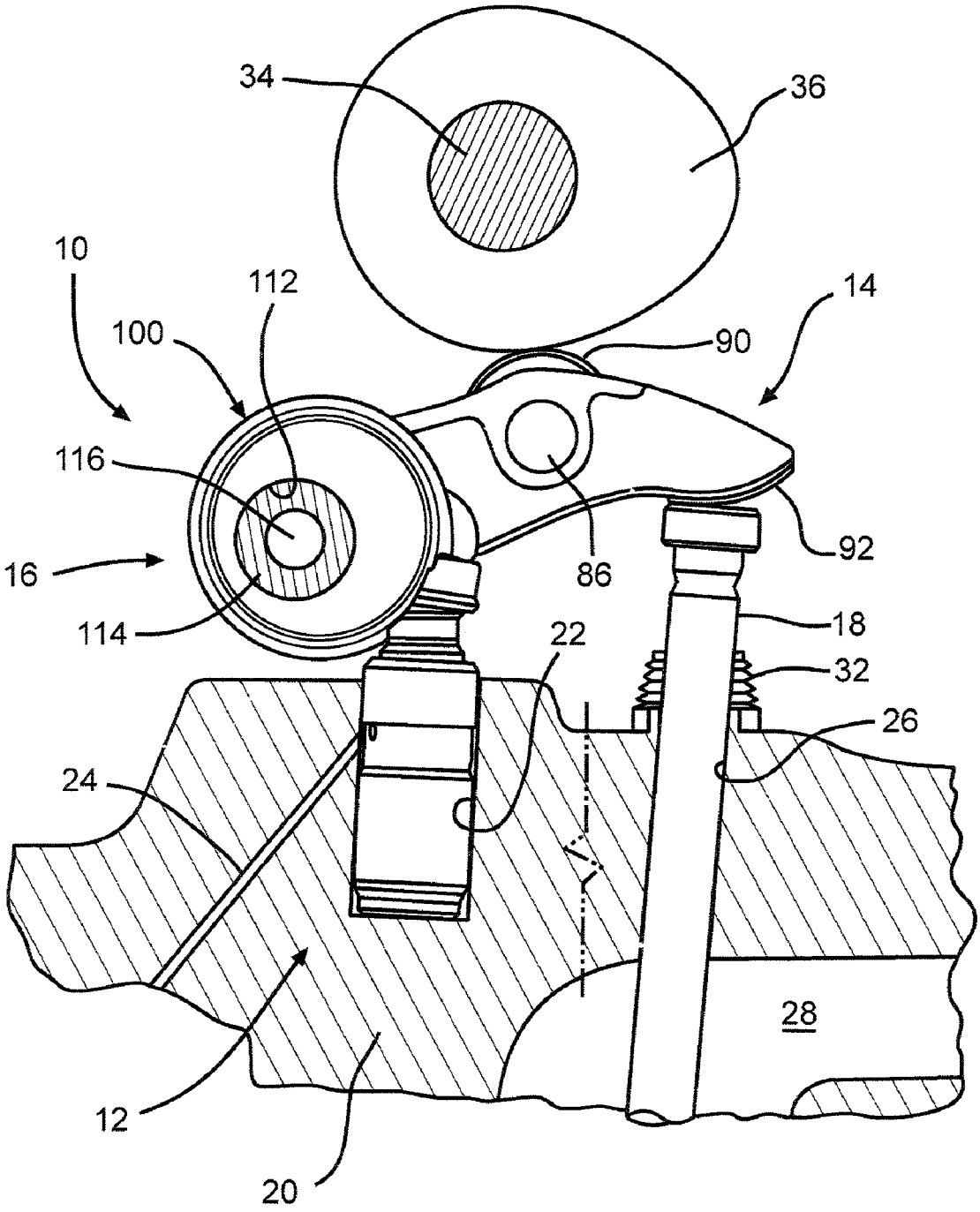
FIG. 1 is a side elevational view with portions broken away of a hydraulically lashed end pivot rocker arm assembly according to the present invention.

With reference now to FIG. 1, a hydraulically lashed end pivot rocker arm assembly according to the present invention is illustrated and generally designated by the reference number 10. The hydraulically lashed end pivot rocker arm assembly 10 includes a hydraulic lash adjuster assembly 12, a rocker arm assembly 14, an eccentric rocker arm adjustment assembly 16 and a valve stem 18 which is a portion of a typical and exemplary intake or exhaust valve.

The hydraulically lashed end pivot rocker arm assembly 10 is associated with and mounted upon a cylinder head 20 which defines a blind bore 22 sized to receive the hydraulic lash adjuster assembly 12. An oil passageway 24 communicates with the blind bore 22 and supplies oil under pressure to the hydraulic lash adjuster assembly 12 in accordance with conventional practice. The cylinder head 20 also defines a through passageway or bore 26 which extends into an inlet or exhaust port 28 and receives the valve stem 18 of an inlet or exhaust valve. Disposed about an upper portion of the valve stem 18 and attached to the cylinder head 20 is a resilient valve stem seal 32. A rotating camshaft 34 is disposed above the rocker arm assembly 14 and extends substantially along the length of the cylinder head 20. Directly above the rocker arm assembly 14 is a cam 36 which is rotated by the camshaft 34. The cam 36 actuates the rocker arm assembly 14 and the valve stem 18 as will be more fully explained below.

Figure 2:
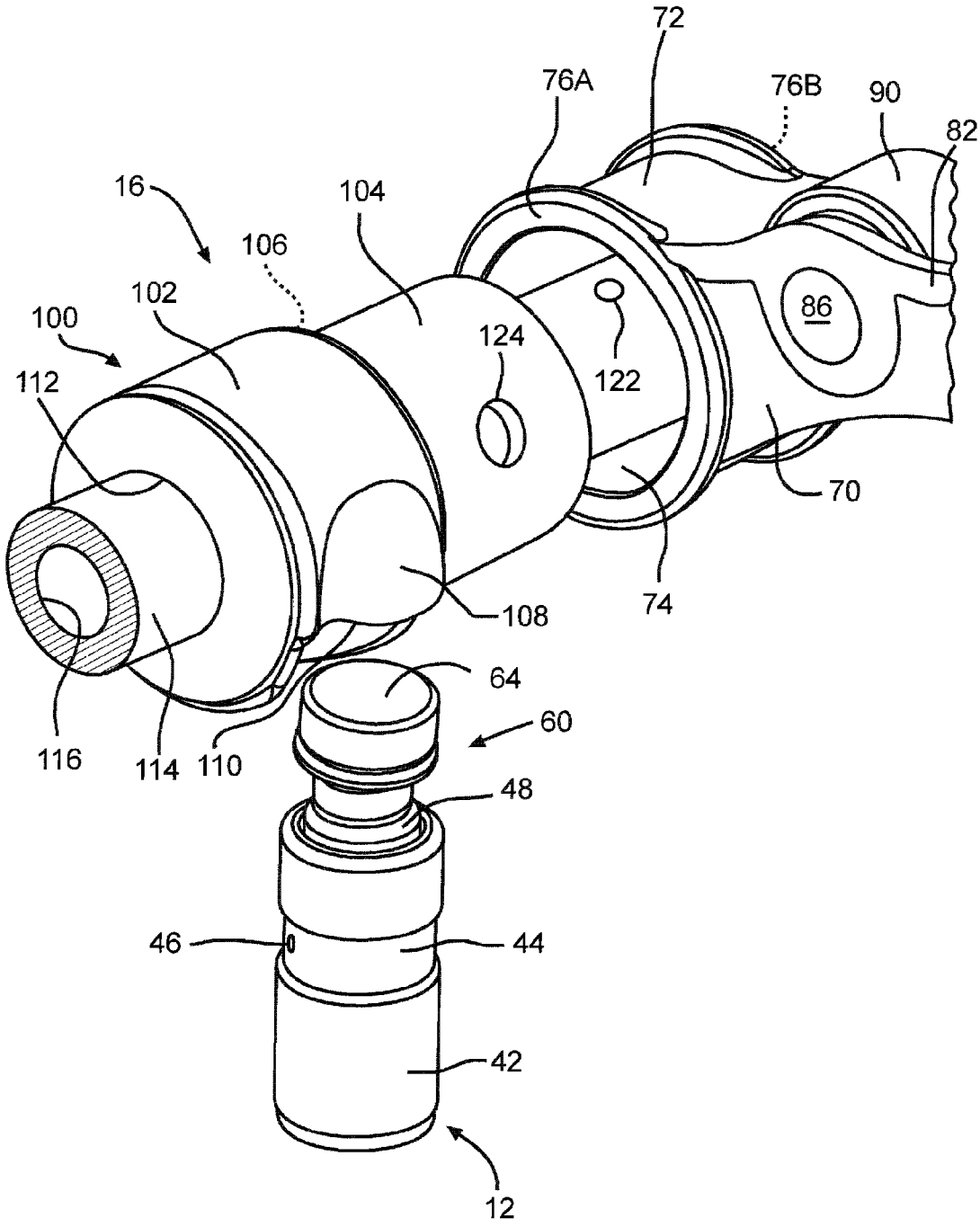
FIG. 2 is an exploded perspective view of a hydraulically lashed end pivot rocker arm assembly according to the present invention.
Figure 3:
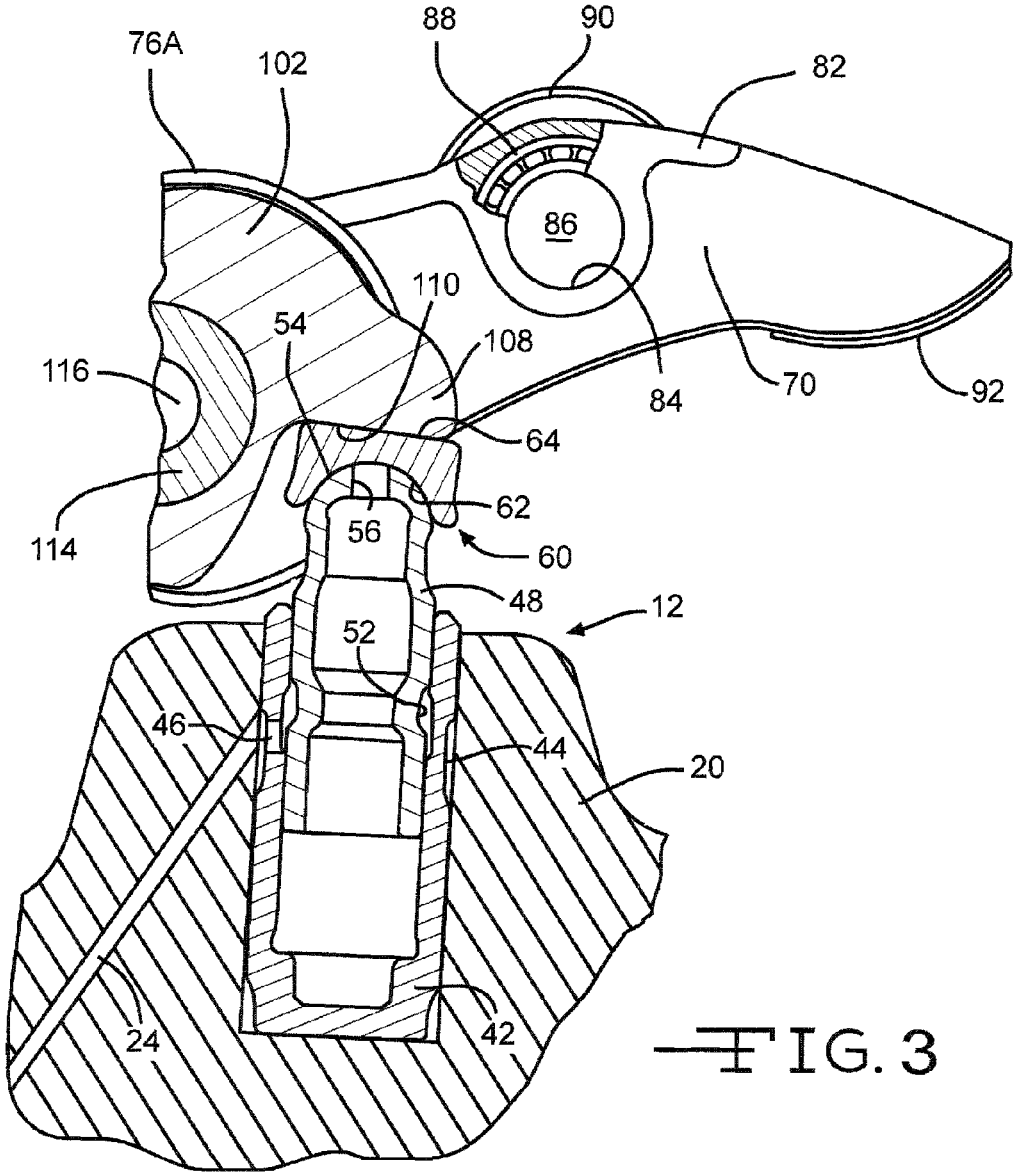
FIG. 3 is a side elevational view in partial section of a hydraulically lashed end pivot rocker arm assembly according to the present invention.

Referring now to FIGS. 2 and 3, the hydraulic lash adjuster assembly 12 includes an outer shell 42 having an annular recess 44 on its outer surface which generally aligns with the oil passageway 24 and at least one through port or passageway 46 which communicates with the interior of the outer shell 42. Slidably received within the outer shell 42 is a cylindrical piston 48 which also includes an annular recess 52 on its outer surface which nominally aligns with the port or passageway 46. The cylindrical piston 48 has a hemi-spherical terminal bearing surface 54 which defines a concentric, axially oriented lubrication port 56. Freely received on the hemi-spherical terminal bearing surface 54 of the cylindrical piston 48 is a bearing cap 60 having a hemi-spherical surface 62 complementary to the hemi-spherical terminal bearing surface 54 of the cylindrical piston 48. The bearing cap 60 also includes a flat surface 64 disposed perpendicularly to the center axis of the hemi-spherical surface 62.

The rocker arm assembly 14 includes an arcuate rocker arm body 70 having an enlarged first end 72 which defines a through cylindrical passageway or bearing 74 and a pair of radially and circumferentially extending shoulders 76A and 76B, one at each end of the cylindrical bearing 74, which function as thrust bearings. A central portion of the rocker arm body 70 includes a pair of spaced-apart walls or webs 82 which each define one of a pair of aligned openings 84 which cooperatively receive and support a fixed stub shaft 86. The stub shaft 86, in turn, supports, through an antifriction bearing assembly 88, such as a ball bearing or roller bearing assembly, a cam follower 90. The cam follower 90 is in contact with and is translated by the cam 36. At the end of the rocker arm body 70 opposite the through cylindrical bearing 74 is a shoe or contact surface 92 which engages and translates the valve stem 18. The contact surface 92 is curved about an axis parallel to the axes of the cylindrical bearing 74 and the stub shaft 86, as viewed in FIG. 3, and is flat when viewed from the end of the rocker arm body 70.

The eccentric rocker arm adjustment assembly 16 includes a stepped cylindrical or tubular body 100 having a first, larger diameter portion 102 and a second, smaller diameter portion 104 and a radially and circumferentially extending shoulder 106 disposed therebetween. The first, larger diameter portion 102 defines a radially extending projection, ear or lug 108 having a flat, radially extending surface 110. It should be appreciated that, depending upon the size or shape of the first, larger diameter portion 102 of the stepped, tubular body 100, the desired or necessary location of the flat surface 110 relative to the axis of rotation of the stepped, tubular body 100 and other variables, the ear or lug 108 may project only slightly from the stepped, tubular body 100 or the ear or lug 108 may essentially not exist in which case the flat, radially extending surface 110 may be recessed within the stepped, tubular body 100.

As illustrated in FIGS. 1 and 2, the stepped, tubular body 100 defines an eccentric through passageway or bore 112 which receives a stationary shaft 114 defining a co-axial through lubrication passageway 116. The stationary shaft 114 is supported in suitable clamp assemblies 120, illustrated in FIG. 4, and receives a supply of pressurized lubricating oil. A plurality of lubricating ports 122 in the stationary shaft 114 are axially arranged to provide lubricating oil to each of the eccentric bores or passageways 112 of each of the stepped, tubular bodies 100 of a valve train. Each of the second, smaller diameter portions 104 of each of the stepped, tubular bodies 100 includes a lubricating port 124 which provides lubricating oil to the interior of the through cylindrical bearing 74 of the rocker arm body 70.

Figure 4:
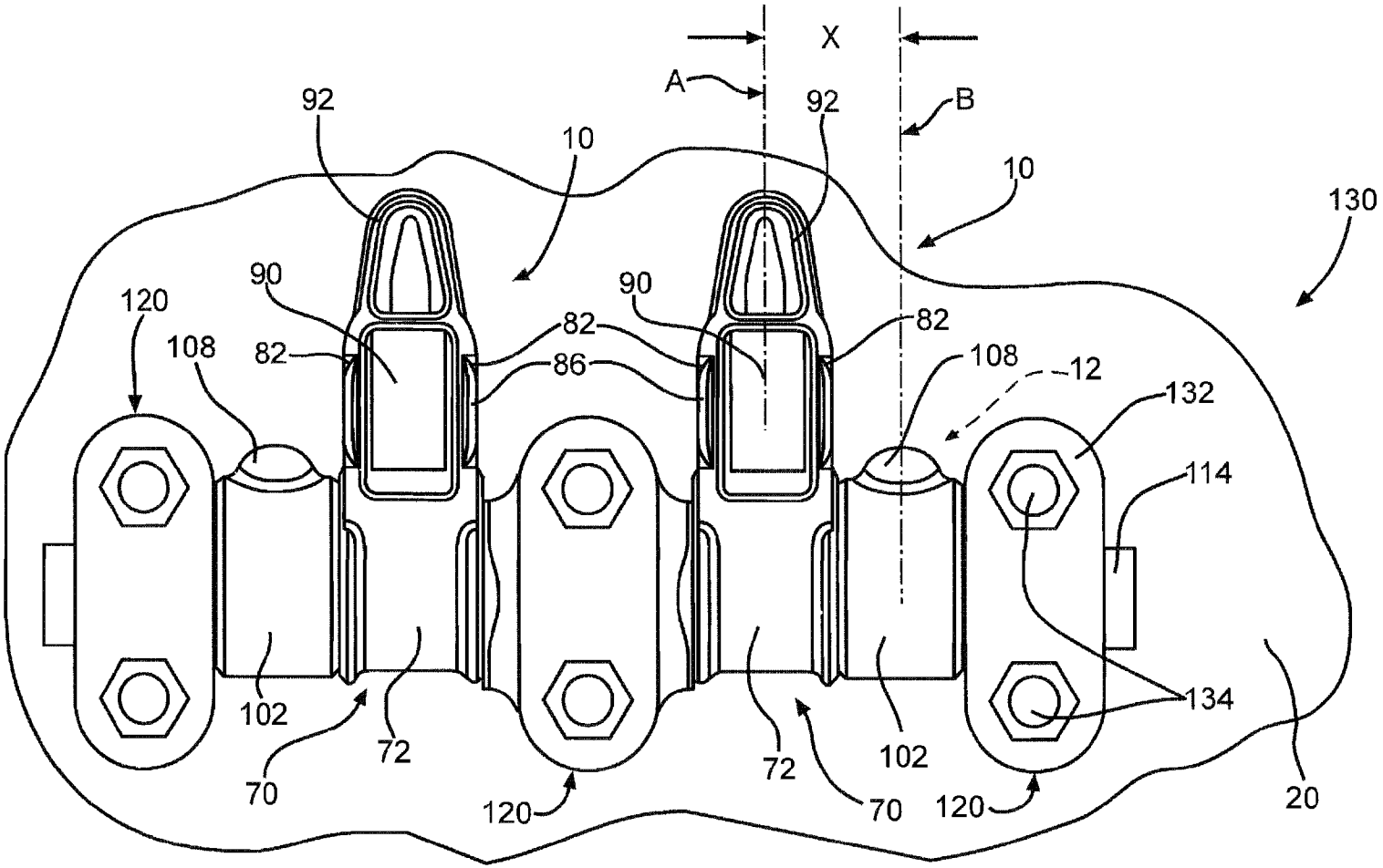
FIG. 4 is a top plan view of a portion of a high performance valve train including a pair of hydraulically lashed end pivot rocker arm assemblies according to the present invention.

Referring now to FIG. 4, a portion of a high performance overhead valve train incorporating the present invention is illustrated and designated by the reference number 130. As viewed and visible from above, each of the hydraulically lashed end pivot rocker arm assemblies 10 includes the rocker arm body 70 having the enlarged first end 72, the pair of spaced-apart walls or webs 82 which support the stub shaft 86 and the cam follower 90 and the shoe or contact surface 92. Immediately adjacent and cooperating with the rocker arm body 70 is the stepped, tubular body 100 defining the first, larger diameter portion 102 which includes the projection, ear or lug 108. Between each of the hydraulically lashed end pivot rocker arm assemblies 10 is a clamp assembly 120 having an upper clamp body 132 defining a first semi-circular passageway which mates and cooperates with a lower feature also defining a second semi-circular passageway. The semi-circular passageways cooperatively receive, support and locate the stationary shaft 114. The upper clamp body 132 is secured to the cylinder head 20 by a pair of threaded fasteners 134.

Inspection of FIG. 4 reveals that the hydraulically lashed end pivot rocker arm assemblies 10 may be manufactured and assembled in either a right hand configuration or a left hand configuration. Furthermore, it should be understood that such right hand and left hand configurations may be intermixed and utilized, as necessary, in the overhead valve train 130 to accommodate the arrangement of intake and exhaust valves in a particular cylinder head 20. Also apparent in FIG. 4 is the offset or axial spacing, designated "X," between the medial vertical reference plane of the rocker arm body 70 and the valve stem 18 designated "A" and the parallel medial vertical reference plane "B" of the hydraulic lash adjuster assembly 12. As noted above, this offset minimizes or completely avoids the problem of a protrusion or boss impinging into the intake or exhaust port associated with the hydraulic lash adjuster assembly 12 mounting in the cylinder head 20 as these components are conventionally in the same vertical plane.

It should also be noted that a hydraulically lashed end pivot rocker arm assembly 10 according to the present invention is capable of providing increased valve travel or lift. For example, many conventional rocker arm configurations provide valve lift on the order of 11 to 12 millimeters (0.433 to 0.472 inches) with somewhat longer rocker arms providing 14 millimeters (0.551 inches) of lift. The hydraulically lashed end pivot rocker arm assembly 10 according to the present invention is capable of providing 17 millimeters (0.669 inches) of valve lift or more.

The description of the invention is merely exemplary in nature and variations that do not depart from the gist of the invention are intended to be within the scope of the invention. Such variations are not to be regarded as a departure from the spirit and scope of the invention.

What is claimed is:

1. A hydraulically lashed end pivot rocker arm assembly comprising, in combination, a rocker arm having a first end defining a cylindrical bearing, a second end having a surface for engaging a valve stem and a cam follower disposed for rotation between said first and said second ends, a hydraulic lash adjuster, a tubular body having a cylindrical portion defining a first axis and received within said cylindrical bearing of said rocker arm, said tubular body also having a through axial bore defining a second axis parallel to and offset from said first axis and a surface engaged by said hydraulic lash adjuster, and a shaft extending through said bore and supporting said tubular body and said rocker arm.

2. The hydraulically lashed end pivot rocker arm assembly of claim 1 further including a camshaft having a cam disposed in operable relationship with said cam follower of said rocker arm.

3. The hydraulically lashed end pivot rocker arm assembly of claim 1 wherein said shaft defines a through bore and at least one communicating radial bore aligned with said tubular body.

4. The hydraulically lashed end pivot rocker arm assembly of claim 1 wherein said cylindrical portion of said tubular body defines a through radial bore extending from said through axial bore.

5. The hydraulically lashed end pivot rocker arm assembly of claim 1 wherein said surface of said tubular body is at least partially on a projection.

6. The hydraulically lashed end pivot rocker arm assembly of claim 1 further including a stub shaft in said rocker arm and an anti-friction bearing disposed between said stub shaft and said cam follower.

7. The hydraulically lashed end pivot rocker arm assembly of claim 1 wherein said rocker arm and said tubular body include opposing thrust bearing surfaces.

8. A hydraulically lashed offset rocker arm assembly comprising, in combination, a rocker arm having a pivot end defining a cylindrical opening, an opposite end having a surface adapted to engage a valve stem and a cam follower disposed between said pivot end and said opposite end, a hydraulic lash adjuster, a cylindrical body defining a first axis and received within said cylindrical opening of said rocker arm, a through bore defining a second axis parallel to and offset from said first axis and a surface engaged by said hydraulic lash adjuster, and a shaft extending through said through bore and supporting said cylindrical body and said rocker arm.

9. The hydraulically lashed offset rocker arm assembly of claim 8 further including a camshaft having a cam disposed in operating relationship with said cam follower of said rocker arm.

10. The hydraulically lashed offset rocker arm assembly of claim 8 wherein said shaft is hollow and is adapted to supply lubricating oil to said through bore of said cylindrical body and said cylindrical opening of said rocker arm.

11. The hydraulically lashed offset rocker arm assembly of claim 8 wherein said cylindrical body includes a thrust bearing shoulder adjacent said rocker arm.

12. The hydraulically lashed offset rocker arm assembly of claim 8 further including a stub shaft in said rocker arm and an anti-friction bearing disposed between said stub shaft and said cam follower.

13. The hydraulically lashed offset rocker arm assembly of claim 8 wherein a first medial reference plane of said rocker arm and a valve stem is offset from a second medial reference plane of said hydraulic lash adjuster.

14. The hydraulically lashed offset rocker arm assembly of claim 8 further including a projection on said cylindrical body at least partially defining said surface.

15. A high performance valve train assembly comprising, in combination, a stationary shaft, a plurality of supports for said stationary shaft, a plurality of rocker arm assemblies disposed on said stationary shaft, each of said rocker arm assemblies including a rocker arm having a cylindrical pivot opening, a valve stem engaging surface and a cam follower, a hydraulic lash adjuster, and a cylindrical body defining a first axis and received within said cylindrical pivot opening of said rocker arm, a through bore defining a second axis parallel to and offset from said first axis for receiving said stationary shaft and a surface engaged by said hydraulic lash adjuster.

16. The high performance valve train assembly of claim 15 wherein said stationary shaft is hollow and supplies lubricating oil to said plurality of rocker arm assemblies.

17. The high performance valve train assembly of claim 15 further including a camshaft having a plurality of cams disposed in operating relationship with a respective one of said cam followers of said rocker arms.

18. The high performance valve train assembly of claim 15 wherein first medial reference planes of said rocker arms and valve stems are offset from second medial reference planes of said hydraulic lash adjusters.

19. The high performance valve train assembly of claim 15 further including a stub shaft in each of said rocker arms and an anti-friction bearing disposed between said stub shaft and said cam follower.

20. The high performance valve train assembly of claim 15 wherein said hydraulic lash adjusters include a hemi-spherical terminal portion and a bearing cap having a complementary internal hemi-spherical surface.

* * * * *